United States Patent [19]

Edgar et al.

[11] Patent Number: 4,662,137

[45] Date of Patent: May 5, 1987

[54] SILO FOR BULK STORAGE OF LARGE QUANTITIES OF PRODUCTS AT CLOSELY CONTROLLED HUMIDITY AND TEMPERATURE CONDITIONS THROUGHOUT

[75] Inventors: Thomas L. Edgar, Plymouth, Minn.; George A. Baker, Batavia, Ill.; Robert P. Comerford, Bunker Hill, Ind.

[73] Assignee: Chicago Bridge & Iron Company, Oak Brook, Ill.

[21] Appl. No.: 813,375

[22] Filed: Dec. 26, 1985

[51] Int. Cl.[4] ..... E04B 7/18

[52] U.S. Cl. ..... 52/245

[58] Field of Search ..... 52/192, 197, 198, 245, 52/249, 302, 247; 220/1.5, 426, 431, 442; 98/31, 34.5, 32, 54, 55

[56] References Cited

U.S. PATENT DOCUMENTS

| | | | |
|---|---|---|---|
| 1,175,237 | 3/1916 | Cavanaugh et al. | 98/54 |
| 2,266,134 | 12/1941 | Wachowitz | 220/426 |
| 2,621,027 | 12/1952 | Tatsch | 98/31 |
| 2,648,848 | 8/1953 | Wirkus | 220/9 |
| 3,047,184 | 7/1962 | Bergen et al. | 220/426 |
| 3,115,819 | 12/1963 | Mahlmeister et al. | 98/34.5 |
| 3,403,614 | 10/1968 | Carnes | 98/32 |
| 3,584,564 | 6/1971 | Rollins | 98/55 |
| 4,000,595 | 1/1977 | Fortescue | 220/426 |

*Primary Examiner*—James L. Ridgill, Jr.

*Attorney, Agent, or Firm*—Marshall, O'Toole, Gerstein, Murray & Bicknell

[57] ABSTRACT

In an improved refrigerated silo, at least the walls of the structure, and preferably the top in addition, have a monolithic structure including spaced air ducts comprising U-shaped channels held against the interior heat conducting wall of the silo by means of an overlayer of a cured- or foamed-in-place expanded plastic material which adhesively contacts both the channels and the wall of the silo and serves as the principal means of maintaining the integrity of the structure. The ends of the channels are interconnected by suitable manifolds or plenums to provide any desired distribution system through which conditioned air can be passed on either a once-through or a recirculating basis. Because the insulation is foamed-in-place, the necessity for handling large panels of preformed insulation is eliminated, as is the necessity for a frame to hold the insulation in place. Further, the layer of insulation seals each of the individual ducts through which the conditioned air passes, thus eliminating the leakage of conditioned air.

7 Claims, 11 Drawing Figures

SILO FOR BULK STORAGE OF LARGE QUANTITIES OF PRODUCTS AT CLOSELY CONTROLLED HUMIDITY AND TEMPERATURE CONDITIONS THROUGHOUT

This invention relates to an improved silo for bulk storage of products which are sensitive to variations in temperature and/or humidity. More particularly, it relates to a silo for the storage of such products in which at least the walls of the silo have a novel construction which enables temperature control of the storage space within the silo to be effected in a more efficent and economical manner than was heretofore possible.

BACKGROUND OF THE INVENTION

The storage of certain products such as granular sugar, grain and industrial fertilizers in bulk requires that the temperature of the storage space be maintained within a narrow range in order to avoid adverse effects on the stored product. In the case of sugar, for example, the atmosphere in contact with the sugar will have a humidity which is in equilibrium with the moisture content of the sugar. If the temperature varies, either throughout the entire storage space or locally within the space, moisture will migrate into or out of the sugar until a new equilibrium is established. In areas of increased moisture content, the sugar may become sticky whereas in areas of reduced moisture content the sugar may cake. Such effects are undesirable since they adversely affect the removal of the sugar from the storage unit by conventional bulk handling machinery.

For the bulk storage of sugar and other materials which are sensitive to temperature and/or humidity, it has been conventional to use large storage silos having provision for maintaining a uniform temperature within the storage space by heating or cooling the side, top and bottom walls of the structure. A typical storage silo, described in Weibull, U.S. Pat. No. 2,935,236, employed hollow side, top and bottom walls through which a stream of temperature conditioned air could be passed to maintain the interior of the silo at the desired temperature. In the Weibull structure, the outer insulation was spaced from the inner silo wall to provide a conduit for conditioned air. Because of the size of the structure, the outer insulation was installed in sections on a metal framework spaced from and supported by the inner silo wall. The inherent permeability of the insulating panels as well as the difficulty in sealing adjacent panels led to the loss of a substantial proportion of the conditioned air, thus increasing the cost of operating the structure. Other difficulties resulted from the necessity for handling and properly fitting many relatively large pieces of insulation, and erecting a scaffold for proper installation of the insulation. All of these factors increased the cost of constructing and operating such a system.

SUMMARY OF THE INVENTION

In accordance with the invention, there is provided an improved silo which can be built and operated at lower cost than silos of the Weibull type. In the silo of the invention, at least the walls of the structure, and preferably the top in addition, have a monolithic structure including spaced air ducts comprising U-shaped channels held against the interior heat conducting wall of the silo by means of an overlayer of a cured- or foamed-in-place expanded plastic material which adhesively contacts both the channels and the wall of the silo and serves as the principal means of maintaining the integrity of the structure. The ends of the channels are interconnected by suitable manifolds or plenums to provide any desired distribution system through which conditioned air can be passed on either a once-through or a recirculating basis. Because the insulation is foamed-in-place, the necessity for handling large panels of preformed insulation is eliminated, as is the necessity for a frame to hold the insulation in place. Further, the layer of insulation seals each of the individual ducts through which the conditioned air passes, thus eliminating the leakage of conditioned air which increased the operating cost of the prior art silos.

BRIEF DESCRIPTION OF THE DRAWINGS

The invention will be better understood from the detailed description which follows taken in conjunction with the accompanying drawings, in which.

DETAILED DESCRIPTION

Figure 1:
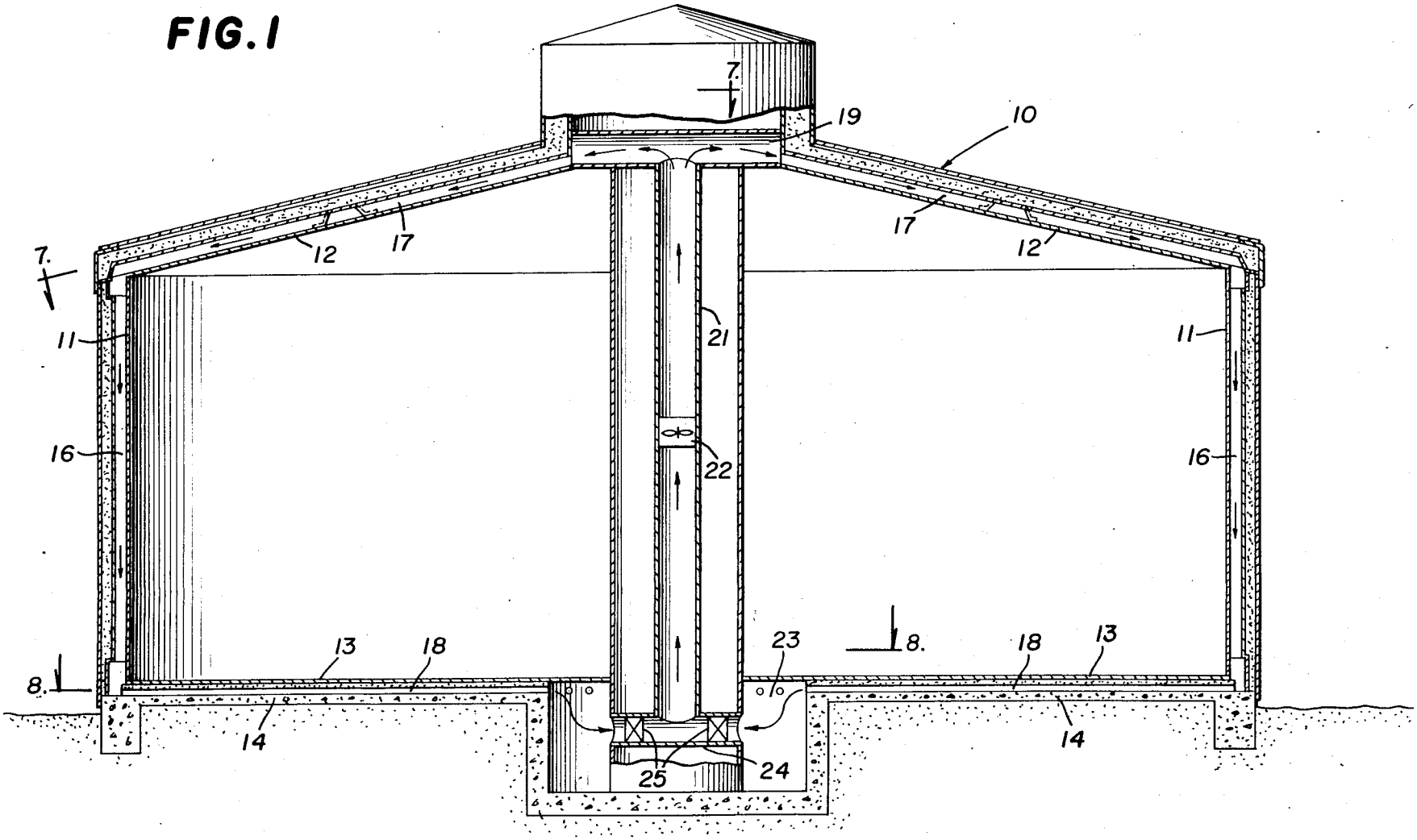
FIG. 1 is an elevational view in partial section of a typical silo of the invention.

As shown in FIG. 1, a silo 10 in accordance with the invention comprises a vertical cylindrical silo shell 11 forming the interior wall surface of the structure, a conical roof plate 12 and a circular bottom plate 13 resting on a suitable concrete base 14. Silo shell 11, roof plate 12, and bottom plate 13 are formed of heat conducting, e.g., metallic, material suitable for direct contact with the heat sensitive material to be stored in the silo, and are suitably joined along their margins to form an enclosed storage space within which an atmosphere of controlled temperature and humidity can be maintained.

Associated with silo shell 11 and roof plate 12 are air ducts 16, 17 through which a stream of air or other fluid having a controlled temperature can be passed to maintain the interior of the silo at a desired temperature. Concrete base 14 is also provided with conduits 18 formed directly therein through which the conditioned air can be passed as a further aid to temperature control. It should be understood that depending on the severity of the conditions which are encountered and the degree of temperature control which is desired, the air ducts associated with roof plate 12 and concrete base 14 can be omitted, if desired.

In the embodiment shown in FIG. 1, air ducts 17 in the roof communicate with an upper central manifold or plenum 19 and a vertical central conduit 21 in which is installed a blower 22 drawing a stream of air from lower central plenum 23 through duct 24 in which is installed an air conditioning system 25 which adjusts the temperature of the air as desired. Lower central plenum 23 communicates with the inner ends of radial conduits 18 within concrete base 14, the outer ends of radial conduits 18 communicating with air ducts 16 associated with the wall of the silo.

The arrangement shown in FIG. 1 illustrates one form of the invention in which theconditioned air is maintained in a closed system recirculating through the central conduit and the air ducts in the walls, top and base of the silo. It should be understood, however, that the arrangement of the cooling air stream is not per se a part of the present invention which lies in the construction of the walls and ceiling of the silo.

Figure 3:
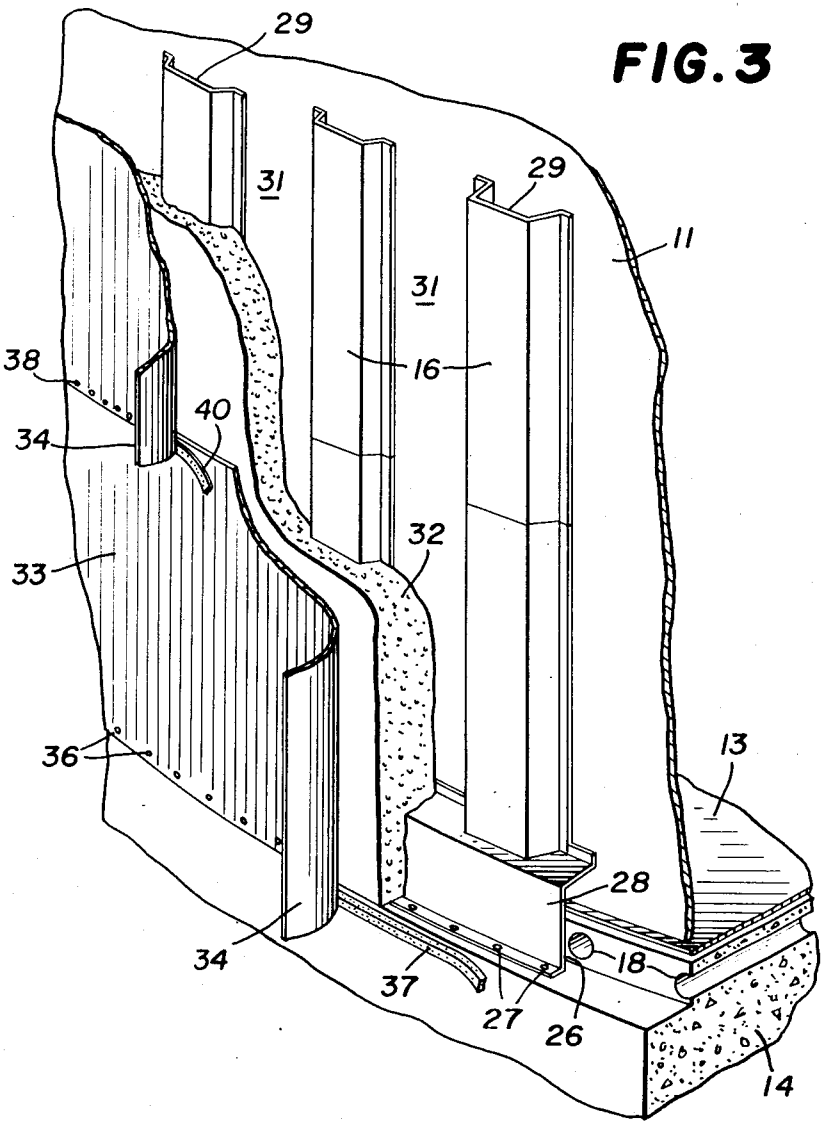
FIG. 3 is a view similar to that of FIG. 2 in the viscinity of the junction between a side wall and the bottom of the silo.
Figure 2:
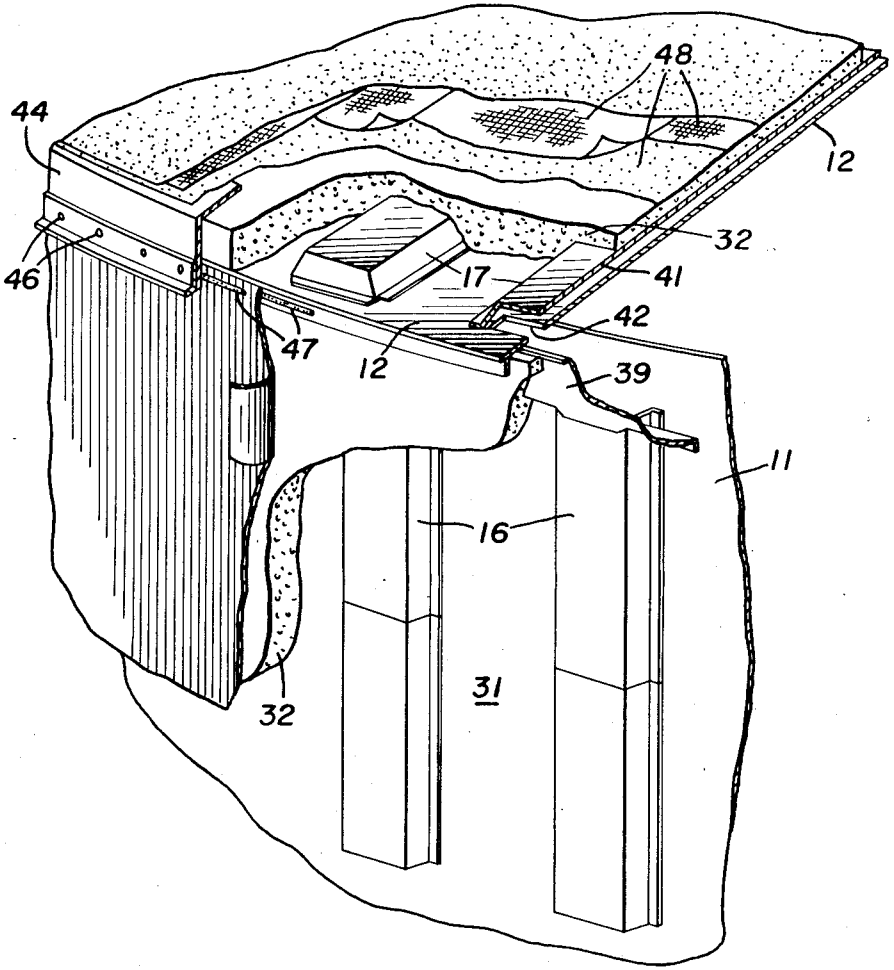
FIG. 2 is a perspective view of a section of the junction between the roof and side wall of the embodiment of FIG. 1, with a portion of the insulation layer removed to show the construction of the air ducts.
Figure 4:
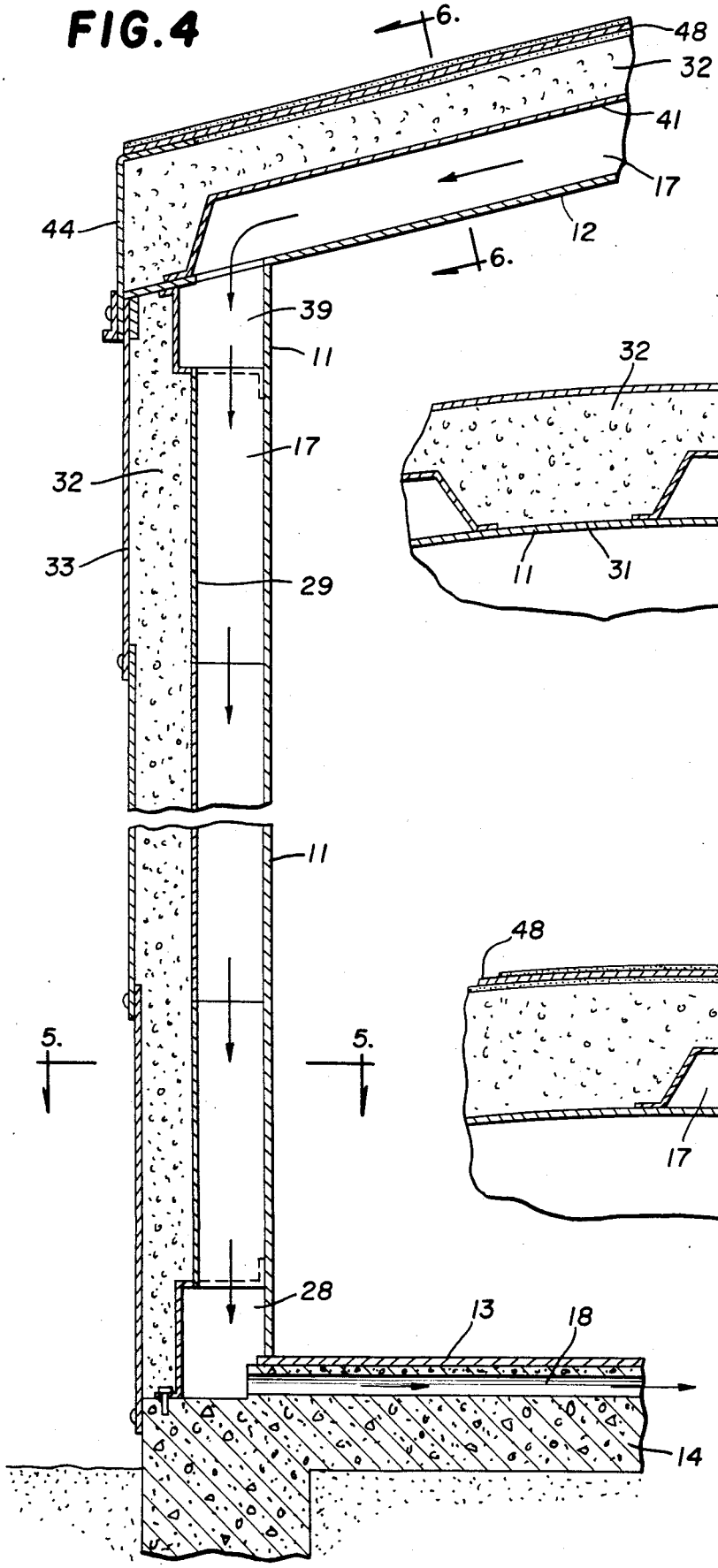
FIG. 4 is an enlarged sectional view of the left wall of the embodiment of FIG. 1 together with a section of the roof structure.
Figure 5:
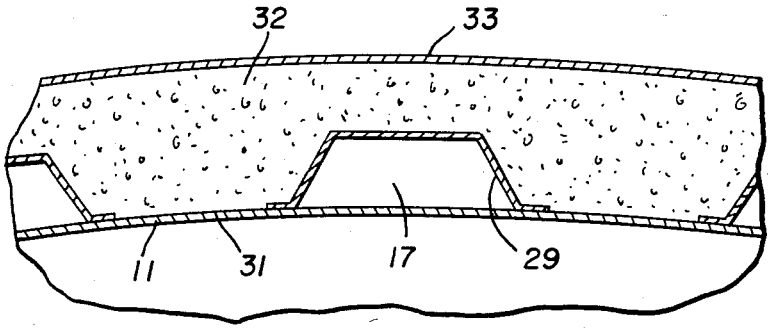
FIG. 5 is a sectional view along the line 5—5 of FIG. 4.
Figure 6:
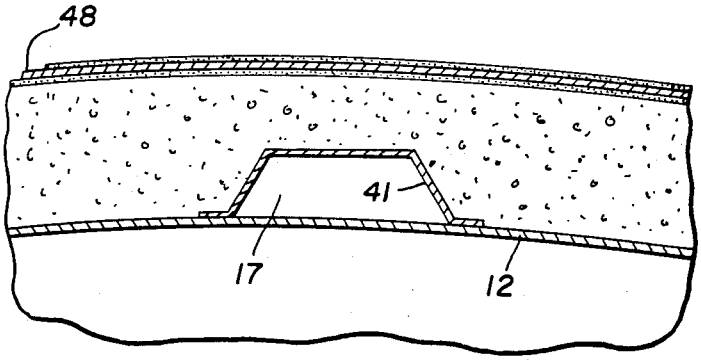
FIG. 6 is a sectional view through the roof of the structure along the line 6—6 of FIG. 4.

The construction of the air ducts within the walls and the roof of the silo is illustrated in FIGS. 2 and 3. As shown in FIG. 3, a plenum member 26 formed suitably of metal or plastic having the form in cross-section of an inverted letter L has its lower edge attached to concrete base 14 by suitable means such as concrete anchors 27. The upper edge of member 26 rests against silo shell 11 forming a lower wall plenum 28 which encircles the silo at its base. Suitably connected to the upper horizontal surface of plenum 28 are a plurality of vertical U-shaped channels 29 positioned with the open side of the channel against silo shell 11. Channels 29 are spaced horizontally around the periphery of the silo, leaving zones 31 in which silo shell 11 is exposed. It is a feature of the present invention that there is no mechanical interconnection between channels 29 and silo shell 11. Rather, the channels are held in place against the face of the shell by means of an external layer of insulation 32, applied to the outer surfaces of channels 29 as well as the uncovered zones 31 of the shell 11, which makes adhesive contact with the surfaces it touches. After the insulation has been cured, it serves as a cement or mastic maintaining channels 29 in position against silo shell 11 as well as sealing the edges along which the channels contact the shell. During application of the insulation, the channels can be held in position against silo shell 11 in any convenient manner, such as by the use of magnets or tape.

Insulation 32 can be any foamed-in-place type of material such as polyurethane which provides an adequate degree of insulation and which is sufficiently adhesive when cured to form a bond with the metal or plastic surfaces to which it is applied. Materials which are appropriate for this use are well known to those skilled in the art. The insulation can be applied either manualy using known methods or by the use of appropriate semi-automatic apparatus similar to that shown in U.S. Pat. No. 3,991,842.

An outer weather-protecting jacket 33 is desirably applied to the insulation. Such a jacket can consist of horizontal strips 34 of a suitable aluminum of steel sheet material, the lower strip of which is connected to concrete base 14 by means of concrete anchors 36 with a strip of sealant material 37 at the joint. Consecutive horizontal layers of the jacket are interconnected by means of lap joints formed with blind rivets 38 over sealant strip 40 in conventional fashion.

When an outer metallic jacket is used as shown in FIGS. 2 and 3, a horizontal strip of jacketing material is preferably supported in position an appropriate distance away from silo shell 11 and insulation 32 is sprayed into the void between the jacket and the silo shell. As the insulation expands and cures, it adheres to the inner jacket surface as well as the exposed surfaces of channels 29 and exposed zones 31 of silo shell 11, forming a strong, leak-free monolithic structure.

As an alternative to the use of an external metal jacket, the curved plastic insulation can be protected against the weather by a layer of a synthetic polymeric coating applied in any appropriate fashion.

Shell 11 is provided at its top edge with an upper wall plenum 39 similar in construction to lower plenum 28, to which the upper ends of wall ducts 16 are connected for air flow. The roof of silo 10 consists of a silo roof plate 12 connected to silo shell 11 and overlapping the shell sufficiently to form the upper surface of plenum 39. Radially spaced on roof plate 12 are inverted channels 41 which communicate with upper plenum 39 by means of appropriately spaced opening 42 in the roof plate. As with the construction of the wall, roof channels 41 are appropriately positioned and then covered with a layer of foamed-in-place insulation which also serves to anchor the channels to the roof plate.

Figure 7:
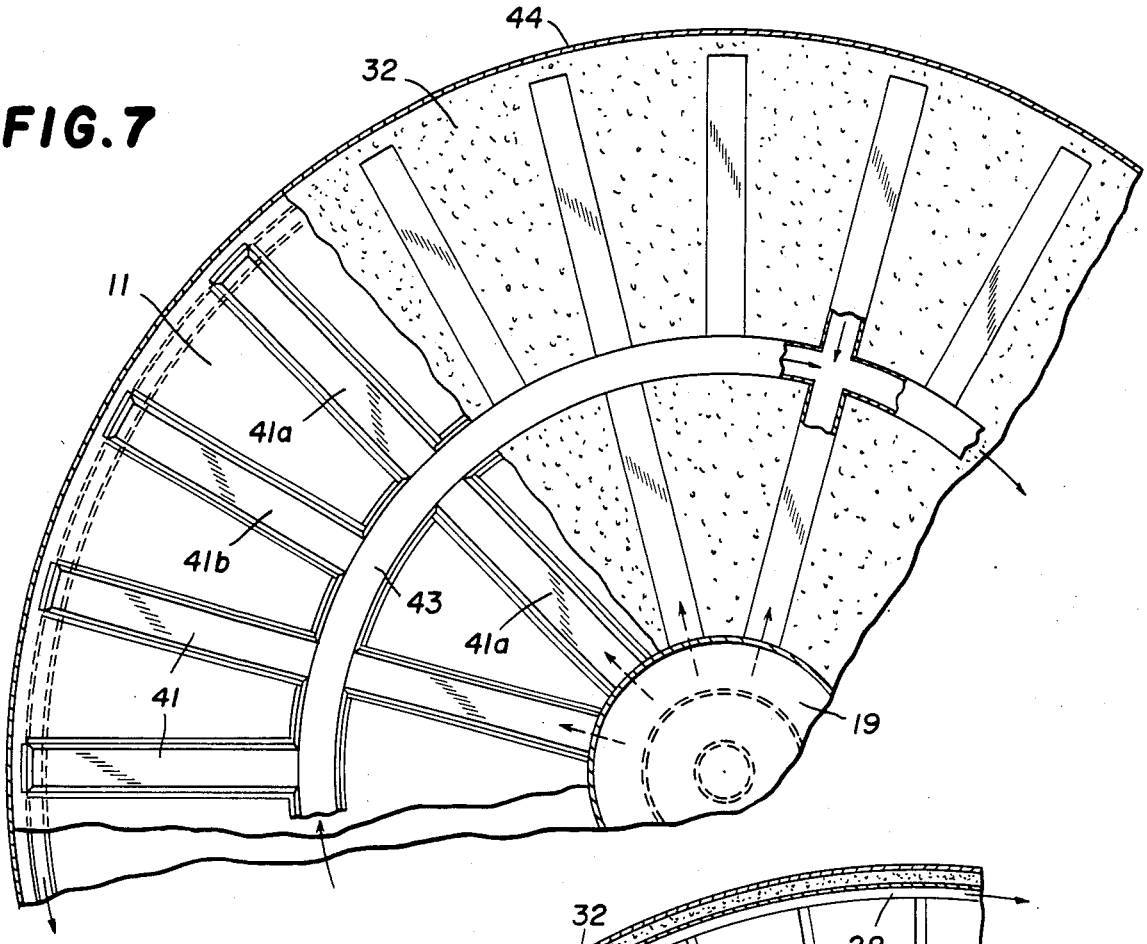
FIG. 7 is a partial top view of the roof of the embodiment of FIG. 1, with a portion of the insulation removed to show the duct network.
Figure 8:
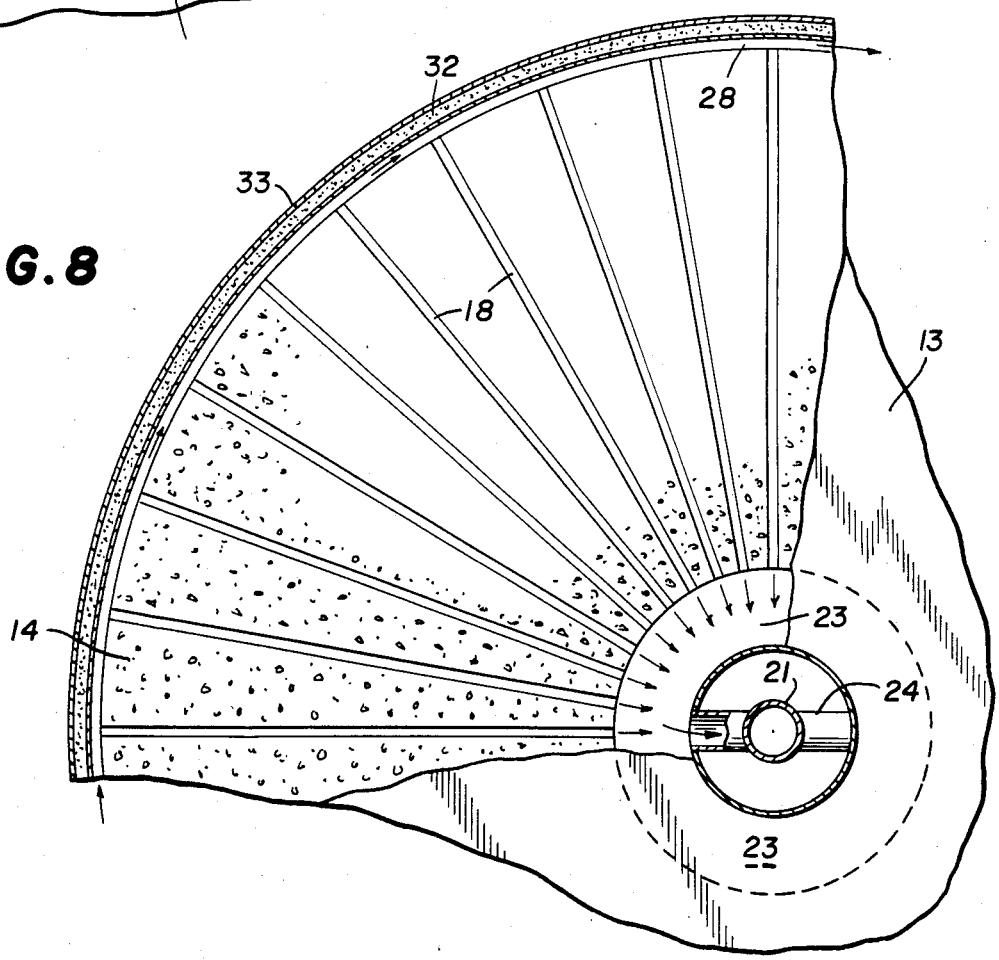
FIG. 8 is a partial sectional view along the line 8—8 of FIG. 1 showing an air distribution system in the bottom of the silo.

As shown in FIG. 7, some of the roof channels, e.g., 41*a*, are full length, i.e., they extend from the outer edge of the roof to substantially the center thereof and communicate with upper central plenum 19. Between the full length channels are disposed substantially shorter channels 41*b* which are interconnected for air flow with the full length channels by means of a circular plenum 43 similarly formed of channel sections.

After insulation 32 applied to the roof has cured, a metal facia 44 is installed around the periphery of the roof and connected to metal jacket 33 by means of rivets 46 incor-porating appropriate sealant strips 47. Applied to the top of the roof for protection against the weather is a suitable covering typically consisting of several layers of a mastic reinforced fiberglass cloth 48.

Figure 9:
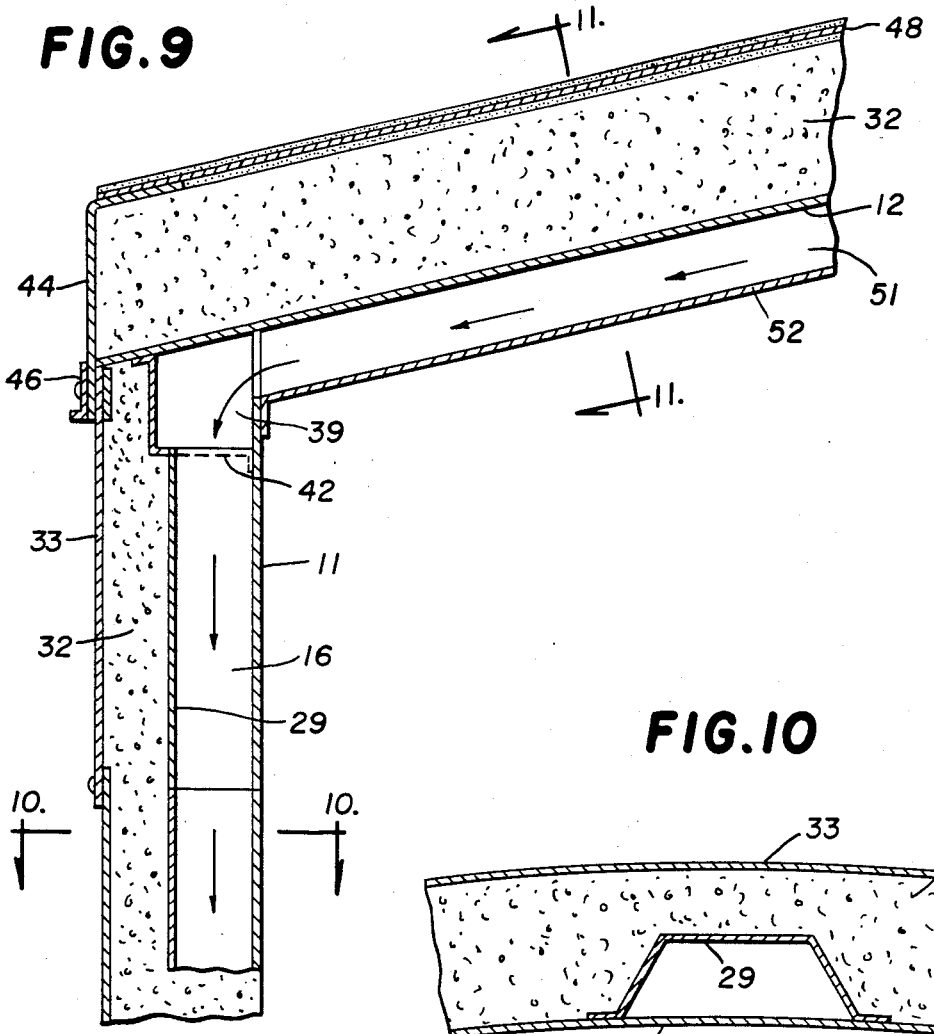
FIG. 9 is a view similar to that of FIG. 4 showing a portion of the roof and wall structures in which the air ducts in the roof are installed below the silo roof plate.
Figure 10:
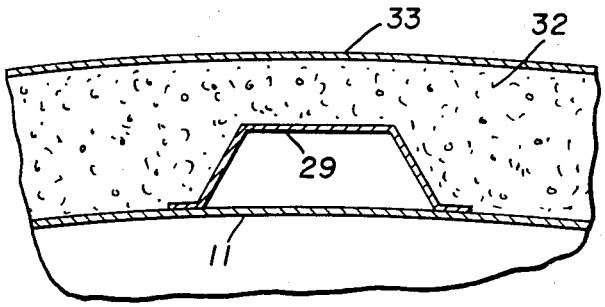
FIG. 10 is a sectional view of the wall of FIG. 9, taken along the line 10—10.
Figure 11:
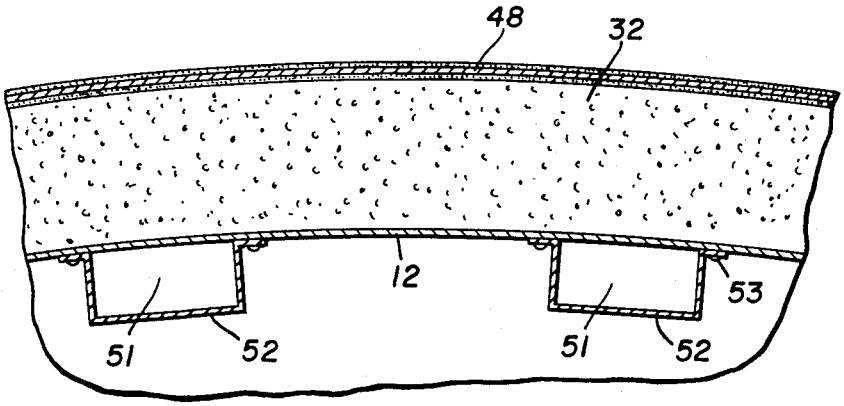
FIG. 11 is a partial sectional view of the roof structure of FIG. 9, taken along the line 11—11.

FIGS. 9, 10 and 11 illustrate an alternative construction for the roof of the silo in which air ducts 51 are defined in part by channels 52 which depend from the roof plate 12 rather than resting on it. In this embodiment, the channels are attached to the undersurface of the roof plate by suitable means such as welding or an appropriate adhesive, rather than by the insulation 32 which covers the roof of the silo.

It will be seen that the structure shown in FIG. 1 provides a system for recirculating conditioning air as desired through the top, bottom and wall surfaces of the silo. The foamed-in-place plastic which covers the roof and walls forms a sealed monolithic structure having no seams or penetrations through which the conditioning air can leak or escape. In addition, since the application of foamed-in-place materials is generally much less expensive than the application of preformed insulating panels, the structure of the invention can be erected at a lower cost than was heretofore required.

The foregoing detailed description has been given for clearness of understanding only and no unnecessary limitations should be understood therefrom, as modifications will be obvious to those skilled in the art.

What is claimed:

1. A silo for bulk storage of heat sensitive materials under controlled substantially uniform temperature conditions, said silo having a roof, a bottom and a vertical cylindrical wall interconnecting said roof and bottom to form an enclosed storage space for said materials, said wall including:

a heat-conducting inner shell, a plurality of vertical generally parallel, laterally spaced U-shaped channels, positioned with their open sides against the outer surface of said shell to form ducts for passage of a temperature-controlled fluid;

a foamed-in-place expanded layer of insulating material covering said channels and the sections of said shell between adjacent channels, said foam layer adhesively contacting said channels and said shell sections and serving as the principal means for holding the channels in place, and a layer of a weather-protecting material applied to the outer surface of said foam.

2. A silo in accordance with claim 1 further including lower and upper plenums interconnecting the respective lower and upper ends of said channels for introducing and recovering said temperature controlled fluid, said plenums being covered with said insulating material.

3. A silo in accordance with claim 2 wherein said outer weather protecting material is a metallic sheet adhesively contacted by said foamed-in-place insulating material.

4. A silo in accordance with claim 3, wherein said roof includes:

a circular roof plate of heat-conducting material;

a plurality of U-shaped channels radially spaced on said roof plate and positioned with their open sides against said plate to form roof ducts for passage of a temperature-controlled fluid, the outer ends of said roof ducts communicating for fluid flow with said upper plenum.

5. A silo in accordance with claim 4 provided with a central plenum communicating for fluid flow with the inner ends of said radial roof ducts, and a central conduit communicating from said central plenum to said lower wall plenum.

6. A silo in accordance with claim 5 wherein said bottom wall is formed of concrete and includes floor ducts formed therein which constitute a portion of said conduit leading from said central plenum to said lower wall plenum.

7. A silo in accordance with claim 6 further including means for circulating a temperature-controlled fluid through a closed system including said lower wall plenum, said wall ducts, said upper plenum, said roof ducts, said central plenum, said central conduit, and said floor ducts, and means for regulating the temperature of said fluid.

* * * * *